United States Patent [19]

Hayes

[11] 3,946,673

[45] Mar. 30, 1976

[54] PYROPHORIS PENETRATOR

[75] Inventor: George A. Hayes, China Lake, Calif.

[73] Assignee: The United States of America as represented by the Secretary of the Navy, Washington, D.C.

[22] Filed: Apr. 5, 1974

[21] Appl. No.: 458,149

[52] U.S. Cl. ..... 102/52; 75/176; 102/90; 102/92.1

[51] Int. Cl.[2] ..... F42B 11/14

[58] Field of Search ... 102/52, 90, 66, 6, 92.1–92.6; 75/176

[56] References Cited

UNITED STATES PATENTS

| | | | |
|---|---|---|---|
| 1,658,712 | 2/1928 | Fonda | 75/176 |
| 2,801,590 | 8/1957 | Balke et al. | 102/66 X |
| 3,203,349 | 8/1965 | Schonberg | 102/92.4 |
| 3,307,982 | 3/1967 | Kenney | 75/176 |
| 3,518,942 | 7/1970 | Philipchuk | 102/66 X |
| 3,561,363 | 2/1971 | Bukigt | 102/52 |
| 3,599,573 | 8/1971 | Sliney | 102/92.4 |

*Primary Examiner*—Samuel W. Engle
*Assistant Examiner*—Harold Tudor
*Attorney, Agent, or Firm*—R. S. Sciascia; Roy Miller; Lloyd E. K. Pohl

[57] ABSTRACT

Alloys of tungsten, zirconium and one or more binder metals are utilized as pyrophoric penetrators.

2 Claims, No Drawings

PYROPHORIS PENETRATOR

BACKGROUND OF THE INVENTION

1. Field of the Invention.

This invention relates to pyrophoric penetrators. More specifically, this invention relates to the use of certain alloys as pyrophoric penetrators.

2. Description of the Prior Art.

The use of penetrators in small arms and artillery projectiles to provide armor piercing capabilities is well known. It is also well known that, in some cases, it is desirable to provide both armor piercing and pyrophoric capabilities. In these cases, devices commonly known in the art as pyrophoric penetrators are used.

In the prior art, pyrophoric penetrators have predominantly been fabricated from uranium or uranium alloys. The use of uranium or uranium alloys has one major drawback. That drawback is the fact that the U.S. Government has restrictions on the use of uranium for penetrator applications. Accordingly, it is the primary objective of this invention to provide pyrophoric penetrators for small arms projectiles, artillery projectiles and the like which do not utilize uranium.

SUMMARY OF THE INVENTION

Alloys containing tungsten, zirconium and binder metals in certain preferred weight percentage ranges are utilized as pyrophoric penetrators. The alloys may be fabricated, in the actual forms that they will take as penetrators, by any one of several techniques or they may be fabricated in other forms and machined into the shape of penetrators. Penetrators fabricated from the herein specified alloys have terminal ballistic characteristics similar to penetrators fabricated from uranium and uranium alloys.

DESCRIPTION OF THE PREFERRED EMBODIMENT

The preferred pyrophoric penetrators according to this invention contain from 95 to 49 weight percent tungsten, from 50 to 4 weight percent zirconium and from 10 to 1 weight percent binder metals. A wide variety of binder metals may be used. Any ductile metal or combination of metals which is compatible with both tungsten and zirconium may be used. The purpose of the binder metal or metals is simply to hold the alloy together and lend processability to it. Nickel alone may be used as the binder metal. Nickel and iron in combination may be used. Iron alone may be used. Cobalt may be used. Copper may be used. Cobalt in combination with nickel, iron or copper may be used. Copper in combination with nickel, iron or cobalt may be used. And other ductile metals, alone or in combination with one another, may be used.

Alloys containing tungsten, zirconium and one or more binder metals may be fabricated into pyrophoric penetrators by means of powder metallurgical processes, spark sintering processes or by explosive or impact compaction.

Perhaps the easiest way to fabricate a pyrophoric penetrator from the metals of this invention is by powder metallurgy techniques. That is, suitable amounts of the various metals (for example, tungsten, zirconium and nickel) are placed in a mold (which may have the shape of the final pyrophoric penetrater), compacted if desired (pressure of from zero to several million psi may be used) and heated. The melting point of the lowest melting metal in the alloy may be used as a guideline in heating. As is well known, it is not desirable, in powder metallurgy techniques, to melt the alloy. Therefore, a temperature just below the melting point of the lowest melting metal in the alloy is used.

In preparing pyrophoric penetrators of this invention by techniques which involve the use of the metal powders, a wide range of particle sizes may be used. The powder particles may vary from 1 micron to 1 mm in largest diameter. Particle size influences penetration, compactability and pyrophoricity. That is, the smaller the particles, the higher the penetration, compactability and pyrophoricity will be. Small particles, by being more easily compacted, yield high density (good penetration), highly pyrophoric penetrators.

In spark sintering, suitable amounts of the various metal powders are placed in a mold, preferably under pressure and subjected to an electric current. In spark sintering, as in powder metallurgy, pressure is not absolutely necessary.

If a mold of suitable shape is not available, the alloys of this invention can be formed in a shape other than that desired for the penetrator and then be machined. However, time and care should be taken when machining them because, when subjected to the usual machining tools, they tend to spark and could represent a fire hazard in a machine shop.

Almost any desirable balance between penetration ability and pyrophoricity may be achieved by properly selecting the respective amounts of tungsten and zirconium used. High amounts of tungsten and low amounts of zirconium lead to penetrators having high penetration ability and relatively low pyrophoricity. Increasing the amount of zirconium while lowering the amount of tungsten increases the pyrophoricity while decreasing the penetration ability.

In tests, pyrophoric penetrators containg 85 weight percent tungsten, 10 weight percent zirconium, 2.5 weight percent nickel and 2.5 weight percent iron were shown to have terminal ballistic characteristics which compared very favorably with presently used pyrophoric penetrators fabricated from uranium alloys. That is, pyrophoric penetrators containing tungsten, zirconium, nickel and iron in the above-specified amounts, when placed in conventional 20 mm. armor piercing projectiles and fired at armor, exhibit both penetration and fire starting capabilities which are similar to uranium alloy pyrophoric penetrators.

What is claimed is:

1. A pyrophoric penetrator fabricated from an alloy which contains from 95 to 49 weight percent tungsten, from 50 to 4 weight percent zirconium and from 10 to 1 weight percent of a ductile binder metal selected from the group consisting of nickel, iron, cobalt, and combinations thereof.

2. A pyrophoric penetrator containing 85 weight percent tungsten, 10 weight percent zirconium, 2.5 weight percent nickel and 2.5 weight percent iron.

* * * * *

UNITED STATES PATENT AND TRADEMARK OFFICE

CERTIFICATE OF CORRECTION

PATENT NO. : 3,946,673

DATED : 30 March 1976

INVENTOR(S) : George A. Hayes

It is certified that error appears in the above-identified patent and that said Letters Patent are hereby corrected as shown below:

Front page, INID number [54] should be corrected by deleting "Pyrophoris" and replacing it with "Pyrophoric".

Signed and Sealed this

Tenth Day of August 1976

[SEAL]

*Attest:*

RUTH C. MASON
*Attesting Officer*

C. MARSHALL DANN
*Commissioner of Patents and Trademarks*